United States Patent [19]

Lyon

[11] Patent Number: 4,974,530

[45] Date of Patent: Dec. 4, 1990

[54] APPARATUS AND METHODS FOR INCINERATION OF TOXIC ORGANIC COMPOUNDS

[75] Inventor: Richard K. Lyon, Pittstown, N.J.

[73] Assignee: Energy and Environmental Research, Irvine, Calif.

[21] Appl. No.: 437,548

[22] Filed: Nov. 16, 1989

[51] Int. Cl.[5] ..... F23G 7/04

[52] U.S. Cl. ..... 110/346; 110/212; 110/213; 110/237; 110/238; 422/182; 431/5

[58] Field of Search ..... 110/237, 212, 238, 213, 110/346; 422/182, 183; 431/5

[56] References Cited

U.S. PATENT DOCUMENTS

| | | | |
|---|---|---|---|
| 3,900,554 | 8/1975 | Lyon | 423/235 |
| 4,350,669 | 9/1982 | Izumi et al. | 423/235 |
| 4,661,056 | 4/1987 | Vickery et al. | 110/212 X |
| 4,743,436 | 5/1988 | Lyon | 423/235 |
| 4,779,545 | 10/1988 | Breen et al. | 110/212 |

OTHER PUBLICATIONS

*NOx Removal Process,* Mitsubishi Heavy Industries, Ltd., Yasuro Takahashi et al., presented at U.S.-Japan NOx Information Exchange, Tokyo, Japan, May 25-30, 1981.

*Brief Communications: Isothermal Quenching of the Oxidation of Wet CO,* James E. Hardy and Richard K. Lyon, Combustion and Flame, 39:317-320 (1980).

*Influence of Inert Gas Pressure on the Kinetics of Wet CO Oxidation,* R. K. Lyon and J. E. Hardy, Combustion and Flame, 45:209-212 (1982).

*Oxidation Kinetics of Wet CO in Trace Concentrations,* Richard K. Lyon, James E. Hardy, and William Von Holt, Combustion and Flame, 61:79-86 (1985).

*Primary Examiner*—Edward G. Favors

*Attorney, Agent, or Firm*—Workman, Nydegger & Jensen

[57] ABSTRACT

It has been found that trace concentrations of organic materials, including toxic organic compounds, oxidize slowly. Safe and reliable incineration of toxic organic compounds at low concentration is provided by injecting a clean fuel such as $H_2$, $CH_4$, or CO into the incinerator combustion chamber to promote rapid oxidation of the toxic organic compounds. It is believed that the clean fuel added to the combustion effluents raises the total concentration of fuel and organic materials above the second oxidation threshold so that the toxic organic compounds are rapidly destroyed.

31 Claims, 7 Drawing Sheets

APPLICATION OF THE PROPOSED PROCESS TO AN INCINERATOR

APPLICATION OF THE PROPOSED PROCESS TO AN INCINERATOR 4.4% $O_2$, 010 ppm $H_2O$, 0.62 sec. 061C OXIDATION OF $C_6H_5Cl$ AT 798 C 0.80sec. 4.8% $O_2$, 1.5% $H_2O$ COMPARISON OF OBSERVED OXIDATION OF C H Cl WITH LITERATURE 0.80sec. 4.8% $O_2$, 1.5% $H_2O$ C H Cl Oxidatation calculated from Lee et. al. (1)

EFFECT OF CO ON $CH_3Cl$ OXIDATION
$O_2$ = 4.6%, $H_2O$ = 1.42%, T = 721C

EFFECT OF (CO) ON THE OXIDATION
OF $C_6H_6$ AND $C_6H_5Cl$ 798C. 0.80sec. 4.8% $O_2$, 1.5% $H_2O$

APPARATUS AND METHODS FOR INCINERATION OF TOXIC ORGANIC COMPOUNDS

BACKGROUND

1. Field of the Invention

The present invention is directed to apparatus and methods for incineration of toxic organic compounds. More particularly, the present invention provides safe and reliable incineration of toxic organic compounds present in low concentrations by injecting a clean fuel such as $H_2$, $CH_4$, or CO into the combustion effluents, or flue gas, to promote rapid oxidation of the toxic organic compounds.

2. Technology Review

Despite the use of apparently conservative design procedures, it is not uncommon for hazardous waste and other incinerators to fail to perform up to design specifications and government performance regulations. Part of this problem is due to the fact that incinerator design is highly dependent on laboratory simulations of the incineration process. There is theoretical evidence to suggest that currently acceptable laboratory simulations are highly misleading. Further, since the process of obtaining a permit to operate hazardous waste incinerators is indirectly dependent on these laboratory permitting procedures.

While there are a many different kinds of incinerators, incinerators are generally two stage devices. The first incinerator stage is a flame zone in which the bulk of the waste being incinerated is destroyed. Wastes, whatever their source, all tend to be quite variable fuels which can cause flame instability and other nonidealities. Because of these nonidealities, some of the waste can escape the flame zone.

The second stage is the section of the combustion chamber which is downstream of the flame. In this second stage any organic compounds which escaped the flame have an extended residence time at elevated temperature and may be destroyed by nonflame thermal oxidation. In most designs, the residence time is at least one second and the average temperature is at least 1000° C. Since, however, 1000° C. is only the average, some of the gases going through the thermal oxidation zone will experience temperatures considerably less than 1000° C.

The procedures for obtaining a permit to operate hazardous waste incinerators are defined by the Resource Conservation and Recovery Act ("RCRA"). A permit to operate is issued after a trial burn has been executed or other appropriate test data obtained which demonstrate that the incinerator satisfactorily converts hazardous waste into nonhazardous compounds when operated under specified conditions. Satisfactory conversion is defined in terms of Destruction and Removal Efficiency ("DRE").

However, since most hazardous waste streams contain many compounds, a trial burn which involves the measurement of all of them would be prohibitively expensive. Intuitively, there is no need to measure every compound, because if those compounds which are most difficult to destroy by incineration are efficiently removed, it would be expected that the easily destroyed compounds are also removed. Consequently, the trial burn involves the measurement of a subset of compounds (the Principal Organic Hazardous Constituents, "POHCs") which are present in the input stream. If the DRE of these POHCs is 99.99 percent or greater, and certain other conditions met, then a permit to operate is granted.

This procedure assumes the existence of a list ranking individual compounds in terms of their relative ease of destruction under incinerator conditions. It can reasonably be argued that the flame zone is not compound selective. Organic materials escape the flame zone because of combustion instabilities and other factors which may be related to the overall properties of the fuel but which do not have any necessary relationship to the individual compounds in the fuel.

Thus, any difference in the incinerator's ability to destroy compounds in a mixture is a result of selectivity within the second stage of the incineration process. This would mean that in choosing the POHCs to be measured in a test burn the permit writer should specify those compounds in the waste stream which are the most resistant to nonflame thermal oxidation. Consequently, the most frequent view is that the incinerability of a given compound is its ranking in a list according to ease of nonflame thermal oxidation.

Numerous prior art studies of the nonflame thermal oxidation kinetics of pure organic compounds have been carried out. In many of these studies, the observed oxidation kinetics are used to estimate T99.99, the temperature at which a one second residence time is sufficient to produce 99.99% oxidation of the starting material. Table 1, quoted from Lee et al., "Revised Model for the Prediction of the Time-Temperature Requirements for Thermal Destruction of Dilute Organic Vapors," *75th Annual Meetino of APCA*, New Orleans, La., June 1982, shows an example of this kind of data. From the values of T99.99, the least incinerable compound studied was methyl chloride, T99.99=1597° F. (869° C.), followed by methane, T99.99=1545° F. (841° C.), chlorobenzene, T99.99=1408° F. (764° C.), and benzene, T99.99=1351° F. (733° C.), and 17 other compounds with even lower values for T99.99.

TABLE 1

| Compound | T99.99 at 1 sec. (°F.) | T99.99 at 2 sec. (°F.) |
|---|---|---|
| Acrolein | 1020 | 975 |
| Acrylonitrile | 1345 | 1297 |
| Allyl Alcohol | 1176 | 1077 |
| Allyl Chloride | 1276 | 1200 |
| Benzene | 1351 | 1322 |
| Butene-1 | 1232 | 1195 |
| Chlorobenzene | 1408 | 1372 |
| 1-2 Dichloroethane | 1216 | 1173 |
| Ethane | 1368 | 1328 |
| Ethanol | 1307 | 1256 |
| Ethyl Acrylate | 1132 | 1092 |
| Ethylene | 1328 | 1281 |
| Ethyl Formate | 1191 | 1145 |
| Ethyl Mercaptan | 778 | 704 |
| Methane | 1545 | 1486 |
| Methyl Chloride | 1597 | 1514 |
| Methyl Ethyl Ketone | 1290 | 1247 |
| Propane | 1330 | 1300 |
| Propylene | 1318 | 1247 |
| Toluene | 1340 | 1295 |
| Triethylamine | 1101 | 1058 |
| Vinyl Acetate | 1223 | 1164 |
| Vinyl Chloride | 1371 | 1332 |

Based upon these data, the normal design for hazardous waste incinerators (a nonflame thermal oxidation zone of one second at 1000° C.) would appear to be very conservative, and with incinerators being designed to operate at a much higher temperature than is necessary for 99.99% oxidation, it would seem unlikely that any should fail to meet regulations. The observed fact, however, is that even well designed incinerators do sometimes fail to meet specifications and regulations. One possible explanation why incinerators often fall short of performance expectations is that the laboratory measurements of incinerability substantially overestimate the ease with which organic materials in trace quantities can be oxidized.

The primary concern in many hazardous waste situations is to destroy a material that is initially at a concentration in the parts per million range and to achieve removals in excess of 99.99%. In the Lee et al. reference referred to above, the initial concentration of the organic compounds going into the reactor was 1000 ppm in all cases. No attempt was made to observe extents of removal greater than 99%. Similarly, in other studies of this type, the initial concentrations are orders of magnitude larger than might be found in practice, and the extents of reaction studied were much less than what is needed in practice. Thus, prior art laboratory studies of incineration generally involve initial and final concentrations which are orders of magnitude greater than those encountered in practice.

Recent evidence suggests the extent to which an organic compound is destroyed by incineration is not independent of the initial concentration of the compound, but that the fraction of the organic material which survives incineration increases with decreasing initial concentration of the organic material.

Research by Lyon and Hardy (Hardy et al., "Isothermal Quenching of the Oxidation of Wet CO," 39 *Combustion and Flame* 317–320 (1980); Lyon et al., "Influence of Inert Gas Pressure on the Kinetics of Wet CO Oxidation," 45 *Combustion and Flame* 209–212 (1982); and Lyon et al., "Oxidation Kinetics of Wet CO in Trace Concentrations," 61 *Combustion and Flame* 79–86 (1985)) suggest that the extent to which a compound is destroyed by incineration may be dependent on its concentration. In a study of CO oxidation it was found that for initial concentrations of CO of 2000 ppm and greater the reaction obeyed first order kinetics, i.e., for a given reaction time the percent of the initial CO remaining unoxidized was independent of the initial CO concentration. However, it was further found that below 2000 ppm the percent of the initial CO remaining after a given reaction time increased with decreasing initial CO concentration. This trend continued until a point was reached at which the final concentration of CO after reaction approached the initial concentration, suggesting that the reaction virtually stopped. For sufficiently small initial concentrations of CO, not merely was the oxidation rate smaller than one would expect from measurements at higher concentrations, but oxidation virtually did not occur.

The existence of a threshold concentration below which oxidation effectively does not occur may be explained by the branching chain theory of combustion reactions. Within the branching chain theory, the observed fact that combustion reactions are much faster than other types of reactions is explained as arising from two causes. First, combustion reactions are rapid because they are exothermic and self-accelerating. Combustion releases heat and the increasing temperature of a gas mixture undergoing combustion makes the combustion reaction go faster, a process which results in the formation of a flame. Of course, combustion can only happen for mixtures containing enough fuel to cause a large temperature change. This leads to the familiar concept of the flammability limit, wherein mixtures that do not contain enough fuel to be strongly self-heating would not burn.

The second reason combustion reactions are rapid relative to other types of reaction relates to the mechanism by which combustion occurs. Except for some special cases not relevant to this discussion, gas phase reactions occur by reaction mechanisms which involve reactive intermediates called free radicals, and the rate of the reaction is proportional to the concentration of intermediates. Most kinds of reactions are limited to whatever concentration of free radicals thermodynamic equilibrium provides.

Combustion reactions, however, occur by what is called a branching chain mechanism in which the reactions which oxidize the fuel produce free radicals. Increasing the concentration of free radicals increases the rate at which the fuel oxidizes which in turn increases the rate of free radical production. Thus, even at constant temperature, a combustion reaction is self-accelerating. One can have a mixture of fuel and air containing so little fuel that it cannot significantly self-heat. If this mixture is heated it will start to react slowly at first, but will react with an accelerating rate as the free radical concentration increases, achieving a rate that is literally explosive.

The foregoing are generally accepted combustion theory principles. The novel concept in Lyon and Hardy's work is the suggestion that there is a second threshold limit for combustion processes. The first limit, the flammability limit, arises from the fact that for a mixture to be self-heating it must contain enough fuel to cause a substantial temperature rise. The second threshold according to Lyon and Hardy, arises from the fact that generating a superequilibrium concentration of free radicals requires a minimum amount of fuel. The existence of a second threshold in combustion processes is supported empirically and by mathematical analysis and by computer modeling experiments. Computer modeling experiments have reproduced the experimental results.

While this second threshold is very low, too low to be a concern in most situations, it is a concern for incineration. In an incinerator the destruction of the toxic organic compounds should come extremely close to 100%. While part of this destruction is achieved in the flame, some of the toxic organic compounds inevitably escape the flame and must be destroyed by thermal oxidation in the combustion chamber.

Even though the second threshold for combustion is very low compared to the flammability limit, it may still be high relative to the emissions of toxic organic compounds which are environmentally acceptable. Thus, it is possible to have a situation in which the amounts of fuel, toxic organic compounds, and other materials escaping the flame are too small to sustain rapid reaction downstream of the flame but too large to be acceptable.

In view of the foregoing, it appears that current laboratory studies which provide the data for incinerator designs may give an overly optimistic description of incineration chemistry. Since, in practice, toxic organic compounds are often at very low concentrations, laboratory tests using concentrations significantly greater than normal may not be reliably used to predict the destruction for lower concentrations of the toxic organic compounds.

There is, of course, an obvious solution to this problem. By making the temperature sufficiently high, virtually complete destruction of the toxic organic compounds is possible. Toxic wastes, however, often contain a variety of toxic heavy metals. The temperature necessary to vaporize these toxic heavy metals varies with the metal. Some heavy metals, such as mercury, are volatile at modest temperatures, while others require very high temperatures for their vaporization. Thus, increasing the operating temperature of the incinerator can increase the number of different heavy metals which are vaporized and the extent of vaporization. This vaporization is irreversible because when the hot gases cool, the vaporized metals condense to submicron particles which are much more difficult to collect than are larger particles.

Consequently, there is a conflict in incinerator design: while operation at lower temperatures can minimize the vaporization of certain heavy metals, such operation would not completely destroy the toxic organic materials. Increasing the temperature can provide complete destruction of these organic materials, but makes the problem of heavy metals vaporization worse.

It is also important to note that in most cases the material being incinerated is a relatively low BTU fuel, so that some auxiliary high BTU fuel, such as gas, oil, or coal, must be used to produce a suitable operating temperature. Hence, increasing the operating temperature of the incineration process has the further disadvantage of greatly increasing the amount of auxiliary fuel which must be used, thereby increasing the operating cost.

From the foregoing, it will be appreciated that what is needed in the art are apparatus and methods for increasing the effectiveness of incinerating toxic organic compounds without increasing the operating temperature.

In addition, it would be a significant advancement in the art to provide apparatus and methods for increasing the effectiveness of incinerating toxic organic compounds existing at low concentrations without increasing the operating temperature.

It would be another important advancement in the art to provide apparatus and methods for decreasing the operating temperature of incineration processes thereby decreasing the problems associated with heavy metals vaporization, auxiliary fuel costs, and slagging and fouling, while maintaining acceptably high destruction levels of the toxic organic compounds in the waste.

Such apparatus and methods for incinerating toxic organic compounds are disclosed and claimed herein.

BRIEF SUMMARY AND OBJECTS OF THE INVENTION

The present invention is directed to apparatus and methods for incineration of toxic organic compounds. More particularly, the present invention provides safe and reliable incineration of toxic organic compounds at low concentration by injecting a clean fuel such as $H_2$, CO, $CH_4$, or any of the paraffinic hydrocarbons into the combustion effluents, or flue gas, to promote rapid oxidation of the toxic organic compounds. $CH_4$ (natural gas) is the currently preferred clean fuel because it is the least expensive, most readily available, and least environmentally damaging.

Due to a second oxidation threshold effect, it has been observed that the last remaining traces of toxic organic compounds oxidize much more slowly than predicted based upon is currently believed that the amounts of fuel, toxic organic compounds, and other materials escaping the flame are too small to sustain rapid reaction downstream of the flame.

To restore a high oxidation rate, small amounts of a clean fuel are injected during the final stages of the incineration process within the scope of the present invention. The clean fuel added to the toxic organic compounds raises the total concentration of fuel and organic materials above the second oxidation threshold so that the toxic organic compounds are rapidly destroyed.

A small amount of the clean fuel will inherently be discharged into the environment within the scope of the present invention. However, by definition, the clean fuel is a great deal more environmentally acceptable than the toxic organic compounds. Thus, the emission of the clean fuel is traded for the emission of a toxic organic compound.

The amount of clean fuel used is preferably less than 0.5 wt % and more preferably less than 0.2 wt % of the flue gas being treated. The use of larger amounts could result in undesirable emissions of the clean fuel. The amount of clean fuel used is preferably greater than 0.01 wt % of the flue gas in order to assure complete destruction of the toxic organic compounds. These small amounts are sufficient to force the oxidation of the toxic organic compounds to completion.

The temperature of the combustion effluents at the point of clean fuel injection is preferably greater than about 700° C. At temperatures below about 700° C. the reaction times needed to oxidize the toxic organic compounds are longer than can conveniently be provided in practical systems.

The temperature of the combustion effluents at the point of clean fuel injection is preferably less than about 1200° C. At temperatures higher than about 1200° C. the reaction times needed for complete consumption of the injected clean fuel are short reactive to the mixing time. Under such conditions, it is difficult for all of the combustion effluents to adequately contact the injected clean fuel. In addition, at temperatures greater than about 1200° C. the risk of unacceptably high vaporization of various heavy metals increases substantially.

The clean fuel is preferably mixed with a carrier gas to increase the momentum of the mixing jet. High momentum of the mixing jet is important to assure adequate contacting between the clean fuel and the combustion effluents. Since the oxygen is necessary in order to oxidize the toxic organic compounds and the fuel, air is one currently preferred carrier gas. Other carrier gases containing oxygen, such as stem and recycled flue gas are also suitable carriers.

Incomplete oxidation of the clean fuel (with the sole exception of hydrogen) will cause carbon monoxide emissions. Accordingly, it is preferred that the reaction time following injection of the clean fuel be sufficient for the carbon monoxide formed from the clean fuel to oxidize to carbon dioxide.

It is, therefore, an object of the present invention to provide apparatus and methods for increasing the effectiveness of incinerating toxic organic compounds existing at low concentrations without increasing the operating temperature.

Another important object of the present invention is to provide apparatus and methods for decreasing the operating temperature of incineration processes thereby decreasing the problems associated with heavy metals vaporization, auxiliary fuel costs, and slagging and fouling, while maintaining acceptably high destruction levels of the toxic organic compounds in the waste.

Additional objects and advantages of the present invention will be apparent from the following description and appended claims taken in conjunction with the accompanying drawings or may be learned by the practice of the invention.

DETAILED DESCRIPTION OF THE PREFERRED EMBODIMENTS

A. Background

Previous efforts to resolve the conflict between avoiding heavy metal vaporization and completely oxidizing the organic compounds have rested on the tacit assumption that there was nothing basically wrong with the chemistry of incineration and that the problem could be resolved by better mechanical engineering. It has been a longstanding belief among mechanical engineers that combustion was a matter of the three Ts: time, temperature, and turbulence. Thus, if incinerators had problems in practice, this was blamed on inadequate mixing and/or inadequate time at temperature. It was believed that if the incinerator could be designed to heat all of the waste materials up to some desired temperature without getting any of it too hot, that this would solve the problem.

Such an approach, of course, has merit. Incinerators involve severe mechanical engineering problems. Even very approximate temperature control is quite difficult because the heating value of the fuel fluctuates. Temperature and mixing permit a better compromise between avoiding heavy metal emissions and completely destroying the organic compounds. However, if there is a problem with the chemistry of incineration, then improving the chemistry should improve the overall performance of the incinerator.

Figure 1:
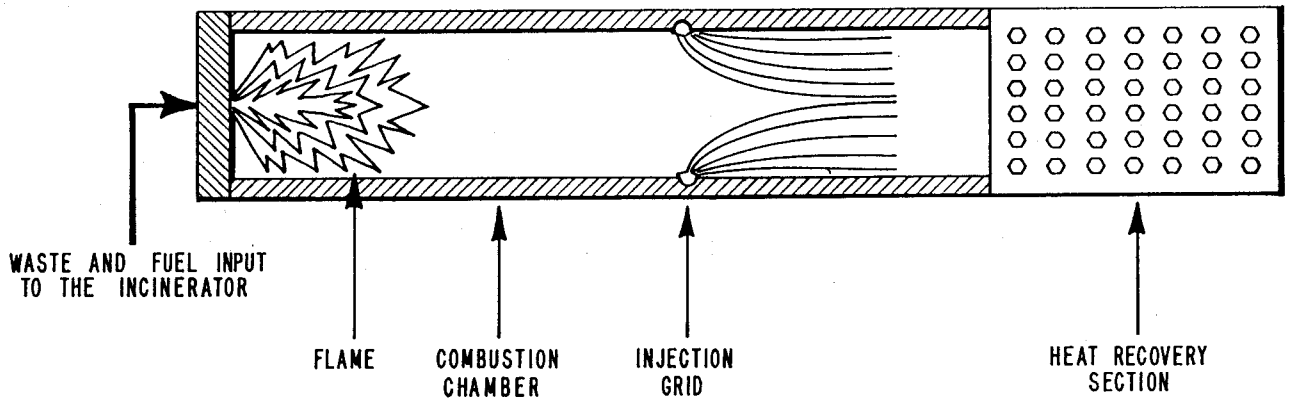
FIG. 1 is a typical design for a liquid waste incinerator within the scope of the present invention showing a set of injectors are along the walls of the combustion chamber for injecting a clean fuel into the incinerator.
Figure 2A:
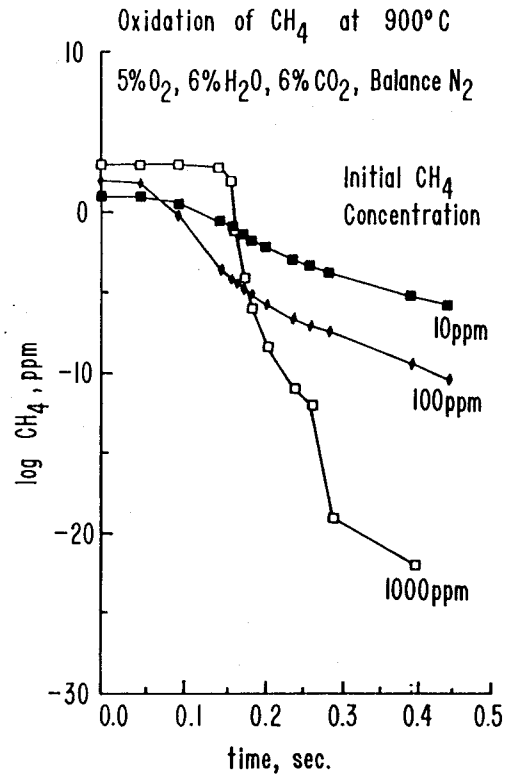
FIG. 2*a* is a graph comparing the oxidation of $CH_4$ at 900° C. with initial $CH_4$ concentrations of 1000 ppm, 100 ppm, and 10 ppm.
Figure 2B:
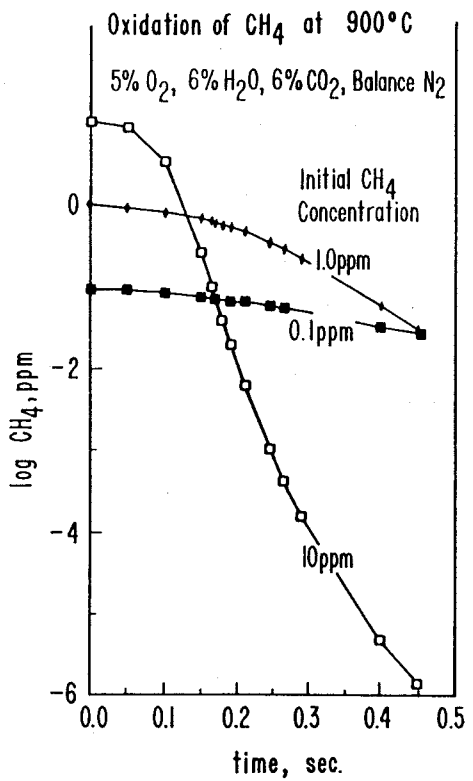
FIG. 2*b* is a graph comparing the oxidation of $CH_4$ at 900° C. with initial $CH_4$ concentrations of 10 ppm, 1 ppm, and 0.1 ppm.
Figure 2C:
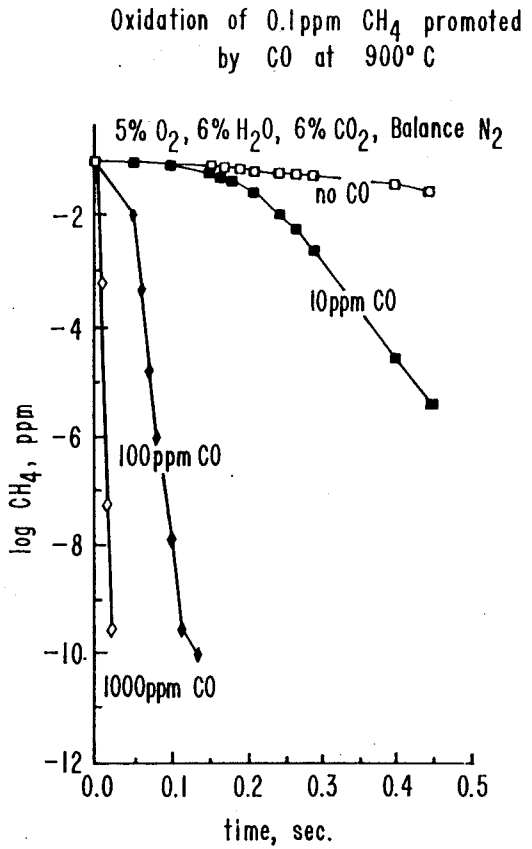
FIG. 2*c* is a graph comparing the oxidation of 0.1 ppm $CH_4$ by itself and with CO added at concentrations of 1000 ppm CO, 100 ppm CO, and 10 ppm CO.

FIG. 1 shows a typical design for a liquid waste incinerator. In it the waste is atomized and fed to a flame as a mist in the primary combustion zone. The combustion zone in which the flame is housed is large enough so that the gases leaving the flame spend time at elevated temperature within a secondary combustion chamber before leaving and being cooled. (A solid waste incinerator would typically involve a rotary kiln with the gases produced by the kiln being conducted to an afterburner. Usually, the afterburner would be housed in a combustion chamber similar to that used in a liquid waste incinerator.)

FIG. 1 also illustrates one possible solution within the scope of the present invention to overcome the prior art problems caused by temperature fluctuations due to variations in the heating value of the waste. The temperature fluctuates between being too high for acceptably low emissions of heavy metals and too low for effective destruction of the toxic organic compounds. While it is possible to control the average temperature of the combustion chamber, the instantaneous temperature fluctuates over some range because of the variations in the heating value of the material being incinerated. Thus, the average temperature is adjusted to be low enough so that the fluctuations to higher temperatures will not cause unacceptably high emissions of heavy metals.

At a lower operating temperature, thermodynamic equilibrium supplies only a few free radicals. If the total concentration of toxic organic compounds and other combustible molecules escaping the flame is below the second threshold for combustion, the organic compounds will oxidize slowly. While a lower operating temperature could result in unacceptably high emissions of toxic organic compounds, this problem is solved according to the principles of the present invention by injecting a small amount of some clean fuel into the combustion effluents.

As shown in FIG. 1, a set of injectors are included along the walls of the combustion chamber for injecting clean fuel into the combustion effluents or flue gas. The injectors are preferably a grid of pipes with holes distributed along their length so that gas may be injected into the combustion chamber and mixed with the combustion effluents. The addition of a clean fuel raises the concentration of combustible materials in the combustion effluents to the point that rapid oxidation of the toxic organic compounds can occur. Of course, in such a procedure some unreacted clean fuel may be present in the gases which are discharged to the atmosphere. However, this is not a serious problem because there are many fuels, such as $H_2$, $CH_4$, CO, or any of the paraffinic hydrocarbons, whose emission at a low level (a few ppm) is quite acceptable. As used herein, the term "ppm" means parts per million by volume with respect to the flue gas. $CH_4$ (natural gas) is the currently preferred clean fuel because it is the least expensive, most readily available, and least environmentally damaging.

The incinerator illustrated in FIG. 1 includes a primary combustion zone where a quantity of waste is burned, typically in a flame. The resulting combustion effluents generally contain a quantity of unoxidized toxic organic materials. Downstream from the primary combustion zone is a secondary combustion chamber. It is in the secondary combustion chamber where organic compounds that escaped the flame have an extended residence time at elevated temperature and may be destroyed by nonflame thermal oxidation.

An injection grid for injecting a quantity of clean fuel into the secondary combustion chamber is provided in the incinerator within the scope of the present invention. The clean fuel, preferably combined with a carrier gas, is injected into the combustion effluents such that the clean fuel and the combustion effluents are mixed. Air, steam, and recycled combustion effluents are currently preferred carriers.

The injection grid is preferably located at a point in the secondary combustion chamber where the temperature of the combustion effluents is in the range from about 700° C. to about 1200° C. The quantity of clean fuel mixed with the combustion effluents is preferably in the range from about 0.01 wt % to about 0.5 wt % based upon the combustion effluents. The residence time of the clean fuel and the combustion effluents within the secondary combustion chamber is preferably controlled such that substantially all of the clean fuel is oxidized If substantially all of the clean fuel is oxidized, then substantially all of the toxic organic materials are oxidized.

B. Computer Modelino Results

1. Without Injection of Clean Fuel

A computer modeling study was done to provide some indication whether or not the injection of a clean fuel into the combustion effluents would promote the destruction of trace quantities of toxic organic compounds. It is suggested that if oxidation of trace concentrations of toxic organic compounds may be forced to completion by injecting a small amount of some clean fuel, then the oxidation of one clean fuel should be forced to completion by injecting small amounts of a second clean fuel. The oxidation of $CH_4$ and of CO are both very well studied processes whose kinetics are well understood and which can be accurately modeled by computer.

For purposes of a calculational example, it is assumed that the gas exiting the flame contains some amount of $CH_4$, 5% $O_2$, 6% $H_2O$, 6% $CO_2$, and balance $N_2$. This gas reacts for 0.5 seconds at 900° C. As shown in FIGS. *2a* and *2b*, if the initial concentration of $CH_4$ is 1000 ppm, there is an induction period after which the $CH_4$ rapidly disappears. By 0.5 seconds, the $CH_4$ concentration falls below $10^{-17}$ ppm and vanishes into the noise of the calculation. If, however, the initial $CH_4$ concentration is 100 ppm, $2\times10^{-11}$ ppm survive; if the initial $CH_4$ concentration is 10 ppm, $5\times10^{-7}$ ppm survive; if the initial $CH_4$ concentration is 1 ppm, $1.8\times10^{\circ}$ ppm survive, and for an initial concentration of 0.1 ppm, the remaining $CH_4$ is $2.5\times10^{-2}$ ppm, fully 25% of the initial concentration. Thus, the modeling calculations clearly demonstrate the existence of a second threshold for methane oxidation.

2. With Injection of Clean Fuel

FIG. *2c* compares the oxidation of 0.1 ppm $CH_4$ by itself and with CO added at the levels of 1000 ppm, 100 ppm, and 10 ppm Whereas 0.1 ppm $CH_4$ by itself is virtually inert, with 10 ppm CO present only $7.4\times10$ ppm of $CH_4$ survive. Increasing the CO to 100 ppm decreases the remaining $CH_4$ to $3\times10^{-10}$ in only 0.14 seconds. After this the $CH_4$ concentration disappears into the noise of the calculation. At a CO concentration of 1000 ppm, the $CH_4$ disappears in only 0.02 seconds.

The computer modeling calculations support the principle within the scope of the present invention of injecting a clean fuel during the incineration process in order destroy small concentrations of waste organic compounds. The computer modeling also approximately defines the conditions to be used for the incineration process within the scope of the present invention. Specifically, the incineration process of the present invention is preferably not operated at temperatures substantially above 1200° C., since the clean fuel has a very short oxidation time under such conditions, so short that it would be difficult to get it mixed with the incinerator flue gas before its oxidation was complete. Temperatures below 700° C. are not preferred, since the fuel's oxidation time would be excessively long at such low temperatures.

At temperatures between 700° C. and 1200° C. the amount of clean fuel injected is preferably controlled so that its oxidation time was long compared to the mixing time, but short compared to the reaction time available within the combustion chamber. This would involve amounts of clean fuel in the range from about 10 ppm to about 2000 ppm by volume with respect to the flue gas.

3 Affect of $SO_2$, NO, and HCl

A typical incinerator flue gas might contain 1000 ppm $SO_2$, 500 ppm NO, and 100 ppm HCl. All three of these substances may influence free radical reactions. Since the reactions of $SO_2$, HCl, and NO which are likely to be important during $CH_4$ oxidation are known, the effects of these species on $CH_4$ oxidation may be calculated.

It was found that when 0.1 ppm $CH_4$ was oxidized in the presence of 10 ppm of CO, adding 500 ppm NO slightly increased the rate of $CH_4$ oxidation while adding 1000 ppm $SO_2$ or 100 ppm HCl decreased the oxidation rate by modest amounts. When, however, 0.1 ppm $CH_4$ was oxidized in the presence of 20 ppm CO, the oxidation of the $CH_4$ went to virtual completion irrespective of the presence or absence of HCl, NO, or $SO_2$. Thus, the effect of these species on the incineration processes within the scope of the present invention, while real, appears to be minor.

4. Dioxin Formation and Destruction

The emission of dioxin even at extremely low levels is perceived by the public to be a matter of great concern. Unfortunately, not only do incinerators fed dioxin-containing wastes fail to completely destroy the dioxin, there is now evidence that incinerators fed any waste containing organic chlorine compounds can produce dioxin, though only in trace amounts.

There is some evidence which suggests that dioxin formation is a low temperatures surface catalyzed reaction between HCl and organic compounds which escape oxidation. As mentioned in the discussion above, HCl has some inhibiting effect on oxidation processes because it is a radical scavenger and raises the second threshold for oxidation. Thus, the presence of substantial amounts of organic chlorine in the waste material increases the HCl available for dioxin synthesis, produces a flue gas in which the second threshold for oxidation is higher, and allows more of the organic precursors to escape. Even at high HCl concentrations, however, enough clean fuel may be injected to get well above the oxidation threshold and force the oxidation of dioxin precursors.

C. Experimental Results

Figure 3:
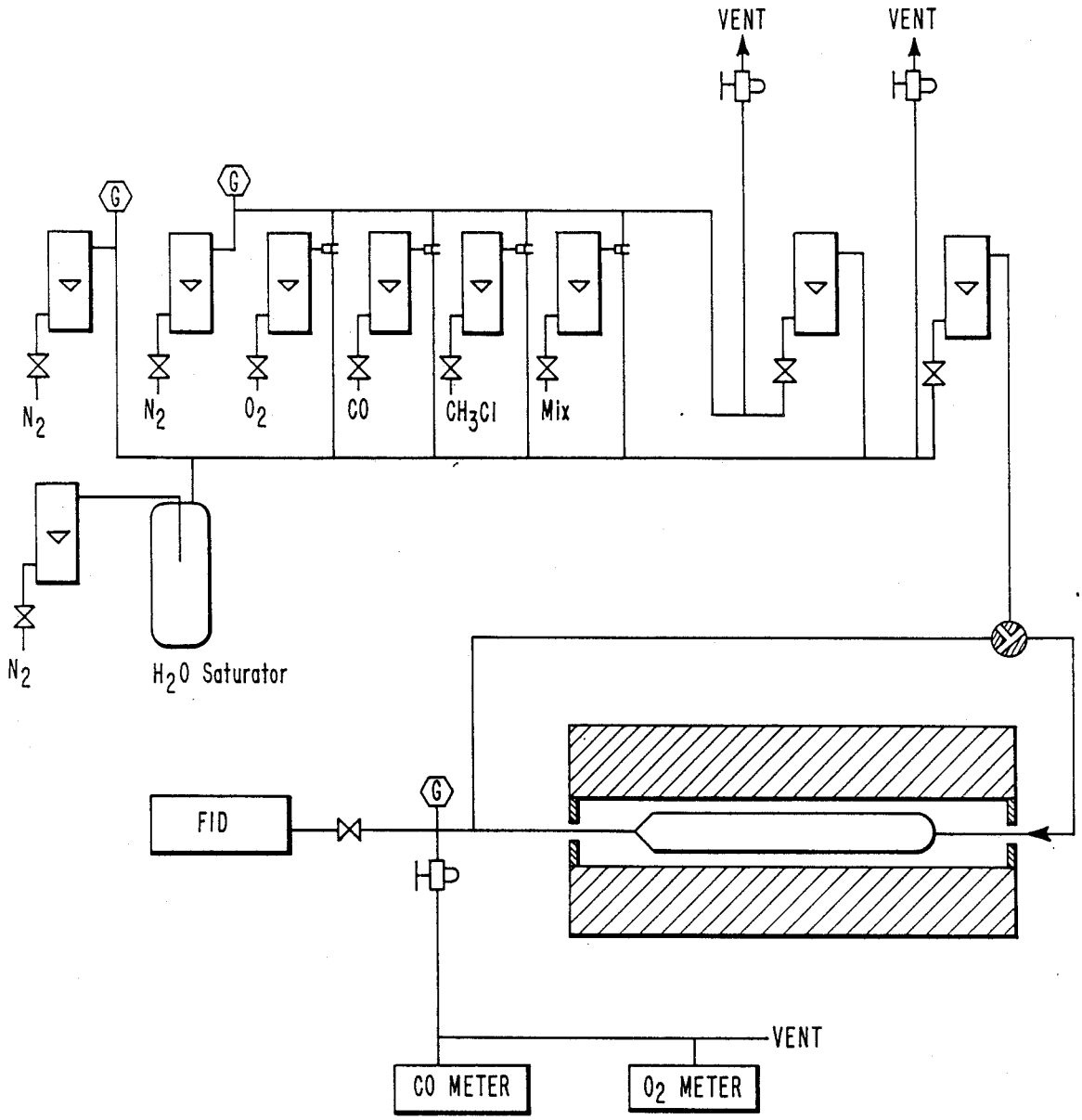
FIG. 3 is a schematic view of a Precision Gas Kinetics Flow System (PGKFS) used in the Experiments within the scope of the present invention.

Experiments were done using a Precision Gas Kinetics Flow System (PGKFS) illustrated in FIG. 3. As shown in FIG. 3 the PGKFS consists of three subsystems: a system for blending fixed gases and vaporized liquids, a reactor, and an analytical train.

The blending subsystem, which uses the dilution blending method, prepared flowing gas mixtures of several components, the amount of each component being accurately known and readily varied in the range of several percent down to the ppm level.

Once the flowing gas mixture was prepared, it was split, part being vented by a back pressure regulator and an accurately measured portion being sent to the reactor. This procedure allowed the reaction time to be accurately varied while holding the mixture composition constant.

The reactor consisted of a quartz tube with capillary inlet and outlet legs in a three zone electric furnace. This system provides an accurately defined time-at-temperature.

For these experiments the analytical train consisted of a Beckman model 400 hydrocarbon analyzer (i.e., a Flame Ionization Detector, "FID") a Teledyne $O_2$ analyzer, and a Thermoelectron Model 48 Gas Filter Correlation CO Analyzer.

The design of the hydrocarbon analyzer required delivery of the sample gas at 5 psig (33 KPa). To meet this requirement the back pressure regulator on the reactor outlet was set at 50 KPa.

Materials used in these experiments included benzene (Baker Analyzed Reagent), chlorobenzene (Baker Analyzed Reagent), methyl chloride (Matheson), nitrogen (Matheson Zero Gas), and Oxygen (Matheson ED). The flame ionization detector and CO analyzer were calibrated daily with Matheson certified analyzed gas blends of $CH_4$ in $N_2$ and CO in $N_2$ respectively. Concentration measurements using the FID were always done on a differential basis, i.e., the concentration of the $CH_3Cl$, $C_2H_6$, or $C_6H_5Cl$ was taken to be the difference between the reading of the FID with an input flow of $CH_3Cl$, $C_6H_6$, or $C_6H_5Cl$ and the reading with that flow turned off. This differential technique greatly reduced problems due to zero drift, etc.

Gaseous mixtures of 1320 ppm $C_6H_6$ in $N_2$ and 1150 ppm $C_6H_5Cl$ in $N_2$ were prepared by evacuating a cylinder, vacuum transferring a measured volume of organic liquid into the cylinder, and pressurizing with $N_2$. Mixing was achieved by applying heat tape to the bottom and one side of the cylinder and allowing it to stand for several days.

The three compounds whose oxidation was studied, methyl chloride, chlorobenzene, and benzene, are all quite oxidation resistant, much more resistant than the intermediates they can form during oxidation. Consequently, a measurement of the total amount of material remaining by flame ionization effectively measures the amount of the starting material remaining. This procedure provides orders of magnitude greater sensitivity than does GC-FID. This greater sensitivity allows the oxidation of the starting material to be observed at much lower concentrations than were used in previous work.

Two series of experiments were done. The first series of experiments demonstrated that the specific rate of oxidation of $CH_3Cl$, $C_6H_6$, and $C_6H_5Cl$ in trace concentrations is much lower than would be predicted from literature measurements at higher concentrations. The second series of experiments demonstrated that the specific oxidation rate of $CH_3Cl$, $C_6H_6$, and $C_6H_5Cl$ in trace concentrations can be greatly enhanced by co-oxidizing the compounds with a higher concentration of some clean fuel.

It is currently believed that in practice the clean fuel will be natural gas. However, the purpose of these experiments was to demonstrate the principles within the scope of the present invention and for that purpose it was more convenient to use a fuel to which the Flame Ionization Detector (FID) is insensitive, such as carbon monoxide.

EXAMPLE 1

In this Example, the oxidation of $CH_3Cl$ was determined at 951° C. using the Precision Gas Kinetics Flow System described above. The initial $CH_3Cl$ concentration was varied from 10.8 ppm to 545 ppm. The input stream also contained 4.4% $O_2$, 616 ppm $H_2O$, and the balance $N_2$. The percent $CH_3Cl$ remaining was determined using the Flame Ionization Detector described above. The reaction time was 0.52 seconds. The results of Example 1 are listed in numerical form in Table 2 and are shown graphically in FIG. 4*a*.

TABLE 2

$CH_3Cl$ Oxidation at 951° C.
4.4% $O_2$, 616 ppm $H_2O$, 0.52 sec

| $[CH_3Cl]_o$, ppm | $CH_3Cl$ Remaining, % |
|---|---|
| 10.8 | 0.298 |
| 22.3 | 0.172 |
| 38.8 | 0.139 |
| 112 | 0.055 |
| 138 | 0.044 |
| 271 | 0.034 |
| 545 | 0.023 |

EXAMPLE 2

In this Example, the oxidation of $C_6H_6$ was determined at 721° C. using the Precision Gas Kinetics Flow System described above. Samples having an initial $C_6H_6$ concentration of 2.2 ppm, 9.5 ppm, and 46 ppm were reacted for varying lengths of time. The input gas streams contained 4.6% $O_2$, 1.42% $H_2O$, and the balance $N_2$. The percent $C_6H_6$ remaining was determined using the Flame Ionization Detector described above. The results of Example 2 are shown graphically in FIG. 5*a*.

EXAMPLE 3

In this Example, the oxidation of $C_6H_5Cl$ was determined at 798° C. using the Precision Gas Kinetics Flow System described above. Samples having an varying initial $C_6H_5Cl$ concentrations were reacted for 0.80 seconds. The input gas streams contained 4.8% $O_2$, 1.5% $H_2O$, and the balance $N_2$. The percent $C_6H_5Cl$ remaining was determined using the Flame Ionization Detector described above. The results of Example 3 are shown graphically in FIG. 6*a*.

Figure 4A:
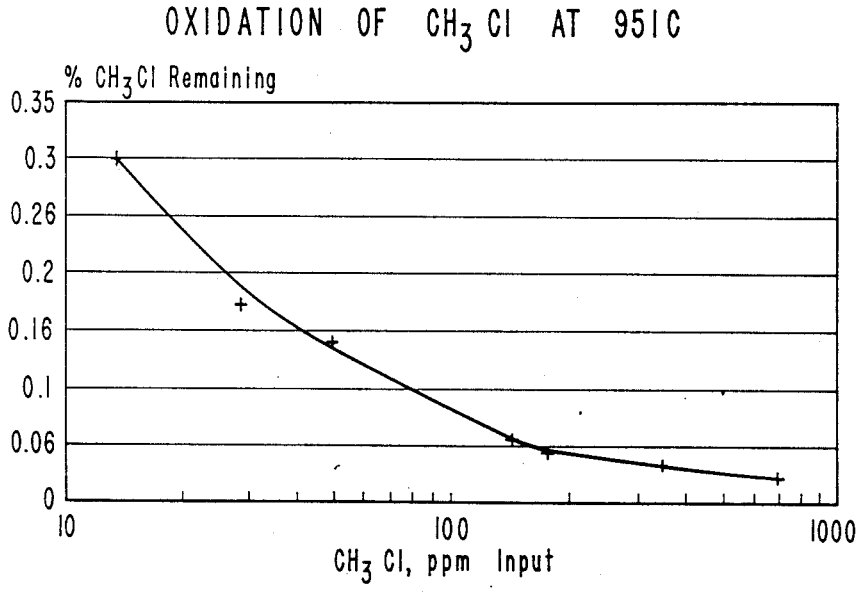
FIG. 4*a* is a graph illustrating the oxidation rate of $CH_3Cl$ at 951° C.
Figure 4B:
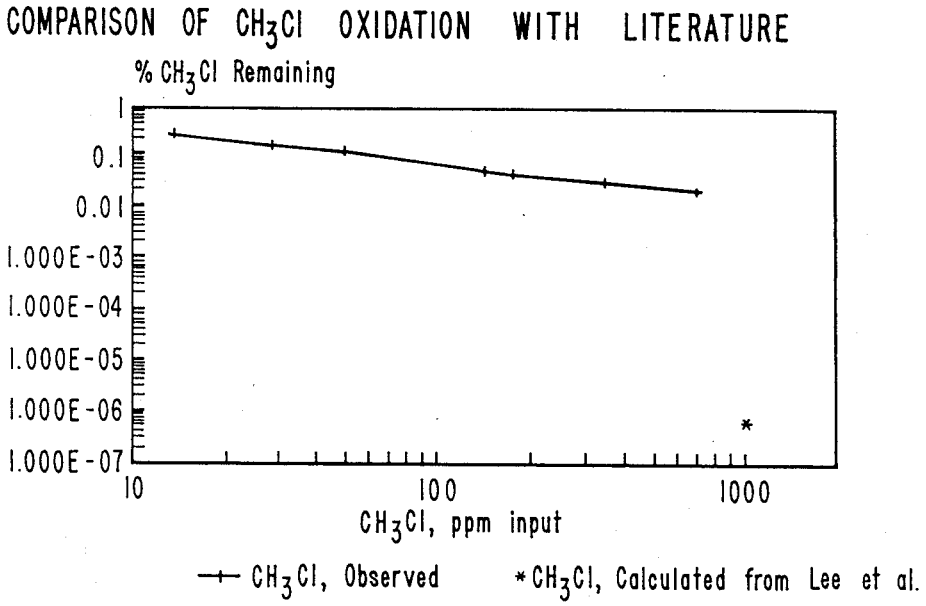
FIG. 4*b* is a replot of FIG. 4*a* on a scale sufficiently expanded to allow comparison with the specific rate of oxidation of $CH_3Cl$ as determined by Lee et al.
Figure 5A:
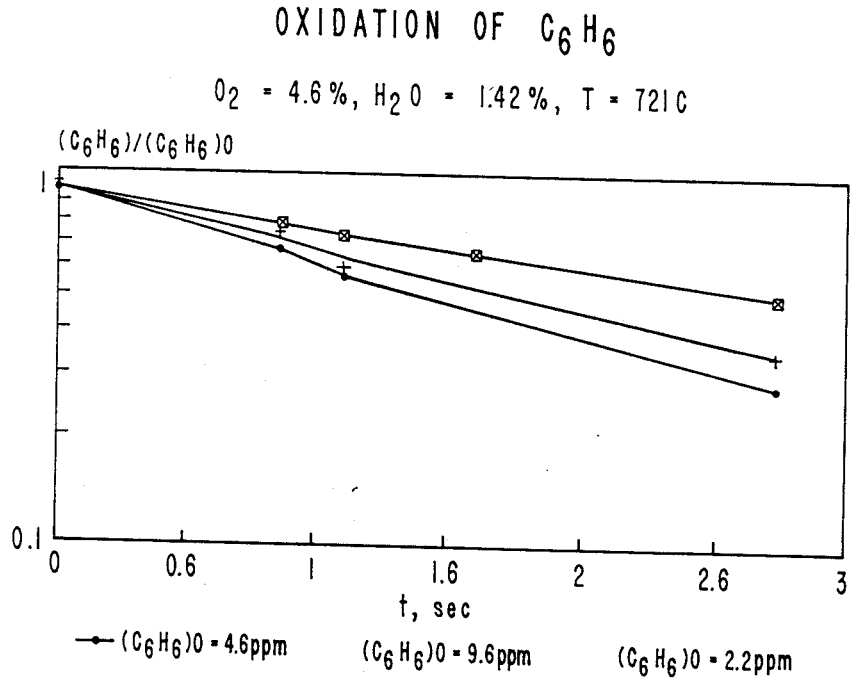
FIG. 5*a* is a graph illustrating the oxidation rate of $C_6H_6$ at 721° C.
Figure 5B:
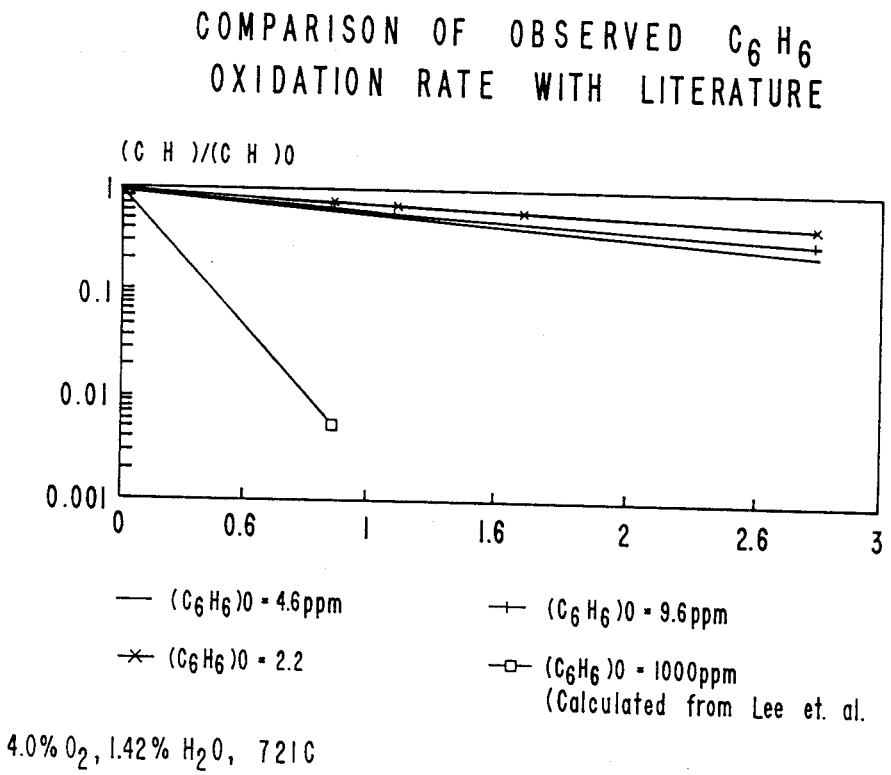
FIG. 5*b* is a replot of FIG. 5*a* on a scale sufficiently expanded to allow comparison with the specific rate of oxidation of $C_6H_6$ as determined by Lee et al.
Figure 6A:
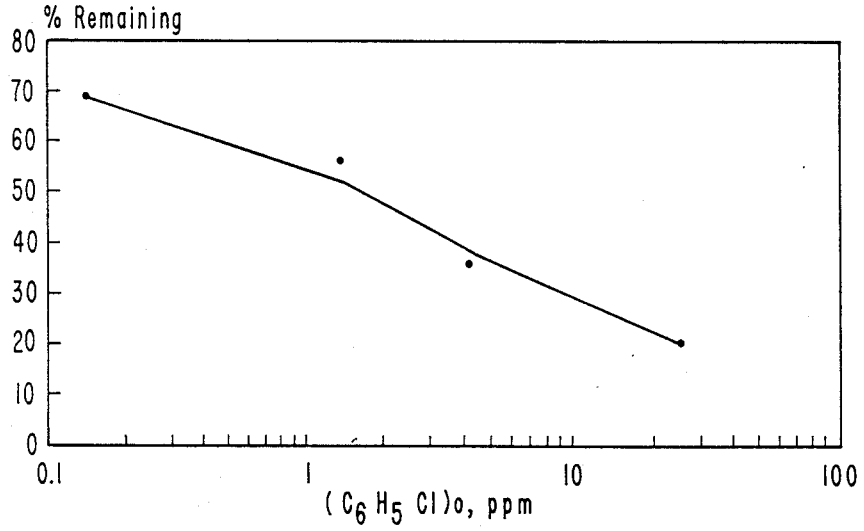
FIG. 6*a* is a graph illustrating the oxidation rate of $C_6H_5Cl$ at 798° C.
Figure 6B:
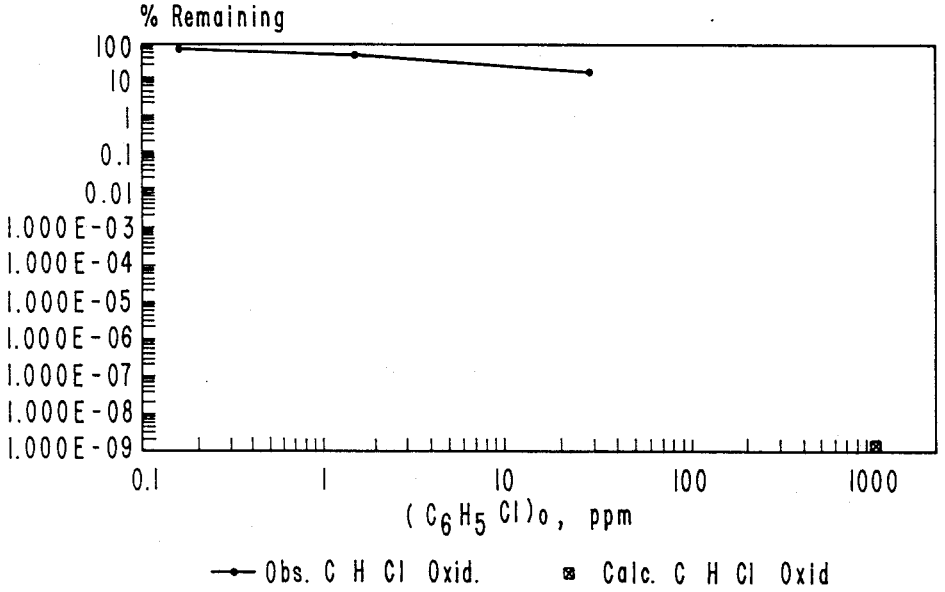
FIG. 6*b* is a replot of FIG. 6*a* on a scale sufficiently expanded to allow comparison with the specific rate of oxidation of $C_6H_5Cl$ as determined by Lee et al.

The data in FIGS. 4*a*, 5*a*, and 6*a* show that the specific rate of oxidation of an organic compound under isothermal conditions does indeed decrease with decreasing initial concentration of the compound. FIGS. 4*b*, 5*b*, and 6*b* are replots of 4*a*, 5*a*, and 6*a* on scales sufficiently expanded to allow comparison with the specific rate of oxidation as determined by Lee et al., "Revised Model for the Prediction of the Time-Temperature Requirements for Thermal Destruction of Dilute Organic Vapors," *75th Annual Meeting of APCA*, New Orleans, La., June 1982. In Lee et al., the specific oxidation rate was measured at such high initial concentration and low conversions that the final concentration is also relatively high.

While any precise comparison of the present results with those of Lee et al. would be difficult for a number of reasons, there is no need to make precise comparisons: the observed extent of oxidation of the test compounds ($CH_3Cl$, $C_6H_6$, or $C_6H_5Cl$) is orders of magnitude less than that predicted by Lee et al. This difference in the specific rate is due primarily to the significantly lower concentrations of the test compounds (both initial and final) used in the experiments.

EXAMPLE 4

In this Example, the effect of CO on the oxidation of $CH_3Cl$ was determined at 721° C. using the Precision Gas Kinetics Flow System described above. This Example included two experiments. The first experiment determined the oxidation rate of $CH_3Cl$ at 72° C. The initial $CH_3Cl$ concentration was 86.4 ppm. The input stream also contained 4.6% $O_2$, 1.42% $H_2O$, and the balance $N_2$. The percent $CH_3Cl$ remaining was determined using the Flame Ionization Detector described above. The reaction time varied from 0 seconds to 2.726 seconds.

Figure 7:
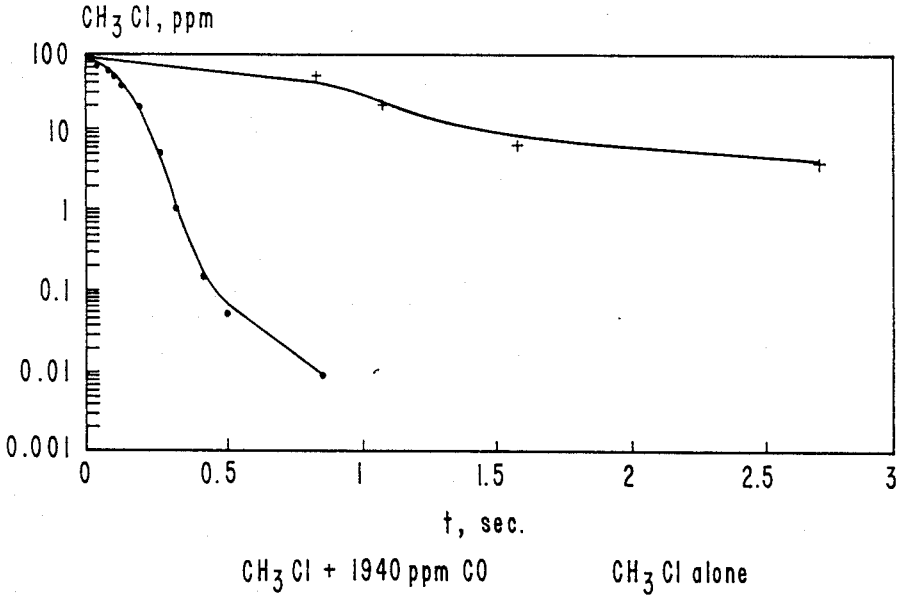
FIG. 7 is a graph illustrating the effect of carbon monoxide on $CH_3Cl$ oxidation.

The second experiment determined the effect of CO on the oxidation of $CH_3Cl$ by adding 1940 ppm CO to the input gas stream. The percent $CH_3Cl$ remaining was determined using the FID, and the reaction time varied from 0 seconds to about 1 second. The results of Example 4 are listed in numerical form in Table 3 and are shown graphically in FIG. 7. The term "ppm C" as used herein means parts per million organic matter as determined by the FID expressed as an equivalent amount of $CH_4$.

TABLE 3

Effect of CO on $CH_3Cl$ Oxidation at 721° C.
4.6% $O_2$, 1.42% $H_2O$

| time, sec | $CH_3Cl$ + 1940 ppm CO ppm C | $CH_3Cl$ alone ppm C |
|---|---|---|
| 0 | 86.1 | |
| 0.071 | 75.5 | |
| 0.091 | 63.2 | |
| 0.12 | 47.8 | |
| 0.19 | 25.6 | |
| 0.261 | 6.7 | |
| 0.322 | 1.36 | |
| 0.416 | 0.194 | |
| 0.505 | 0.07 | |
| 0 | | 86.4 |
| 0.861 | 0.011 | 53 |
| 1.102 | | 22.6 |
| 1.6 | | 7.1 |
| 2.726 | | 4.61 |

EXAMPLE 5

Figure 8:
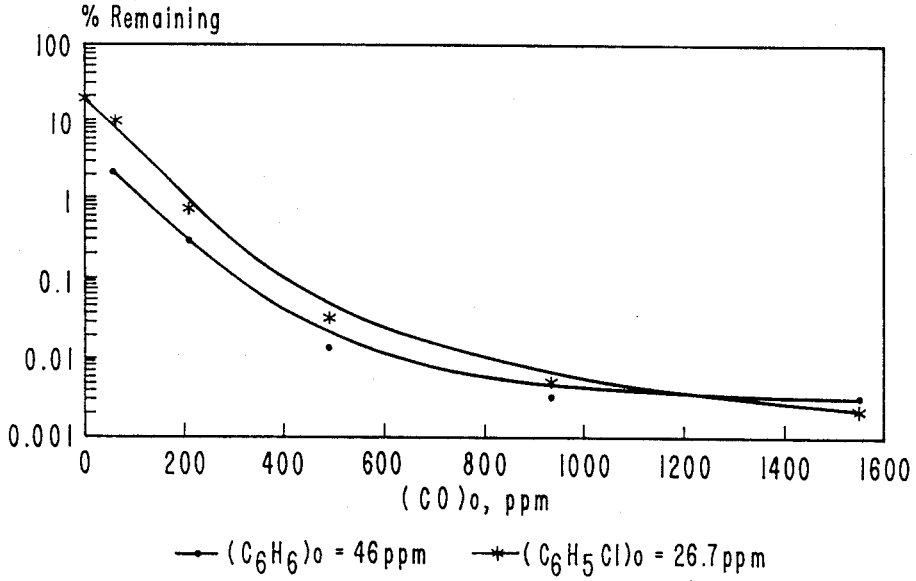
FIG. 8 is a graph illustrating the effect of carbon monoxide on $C_6H_6$ and $C_6H_5Cl$ oxidation.

In this Example, the effect of CO on the oxidation of $C_6H_6$ was determined at 798° C. using the Precision Gas Kinetics Flow System described above. Samples having an initial $C_6H_6$ concentration of 46 ppm were reacted for 0.80 seconds with varying amounts of CO added to the test sample. The input gas streams contained 4.8% $O_2$, 1.5% $H_2O$, and the balance $N_2$. The percent $C_6H_6$ remaining was determined using the Flame Ionization Detector described above. The results of Example 5 are shown graphically in FIG. 8.

EXAMPLE 6

In this Example, the effect of CO on the oxidation of $C_6H_5Cl$ was determined at 798° C. using the Precision Gas Kinetics Flow System described above. Samples having an initial $C_6H_5Cl$ concentration of 26.7 ppm were reacted for 0.80 seconds with varying amounts of CO added to the test sample. The input gas streams contained 4.8% $O_2$, 1.5% $H_2O$, and the balance $N_2$. The percent $C_6H_5Cl$ remaining was determined using the Flame Ionization Detector described above. The results of Example 6 are shown graphically in FIG. 8.

$CH_3Cl$, $C_6H_6$, and $C_6H_5Cl$ are typical of the toxic organic materials found in hazardous waste. Indeed, Table 1, quoted from the work of Lee, et al., shows that they are among the most difficult to incinerate of the toxic organics tested. Thus, Examples 4–6 clearly show that the addition of a clean fuel, such as CO, can greatly increase the oxidation of typical toxic organic.

From the foregoing, it will be appreciated that the present invention provides apparatus and methods for increasing the effectiveness of the incineration of toxic organic compounds existing at low concentrations without increasing the operating temperature. This is accomplished by providing means for injecting a quantity of clean fuel into the incinerator combustion chamber where high temperature thermal oxidation of the toxic organic compounds takes place. Sufficient clean fuel is added to the unoxidized organic material to exceed the second oxidation threshold and permit the oxidation of the organic material.

Additionally, it will be appreciated that the present invention provides apparatus and methods for decreasing the operating temperature of incineration processes, while maintaining acceptably high destruction levels of the toxic organic compounds in the waste. As a result, problems associated with heavy metals vaporization, auxiliary fuel costs, and slagging and fouling are decreased. Contacting a quantity of clean fuel with the flue gas at a point downstream of the combustion chamber enables the toxic organic compounds to be oxidized at temperatures below the vaporization temperature of heavy metals.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A process for enhancing the destruction of toxic organic materials by incineration, the process comprising the steps of:

(a) burning the toxic organic materials in a combustion zone which results in the formation of combustion effluents containing a quantity of unoxidized toxic organic materials, said combustion effluents passing into a combustion chamber downstream of the combustion zone;

(b) contacting a quantity of clean fuel with the combustion effluents at a point downstream of the combustion zone, wherein the quantity of clean fuel contacted with the combustion effluents is less than about 0.5 wt % based on the combustion effluents, and wherein the temperature of the combustion effluents at the point the clean fuel is contacted with the combustion effluents is in the range from about 700° C. to about 1200° C., said contacting occurring in the presence of $O_2$, the concentration of $O_2$ being sufficiently high so that some $O_2$ remains in the combustion effluents after oxidation of the clean fuel; and (c) allowing the clean fuel and the combustion effluents sufficient residence time in the combustion chamber to partially oxidize the clean fuel so as to increase the oxidation of the toxic organic materials.

2. A process for enhancing the destruction of toxic or organic materials by incineration as defined in claim 1, wherein the clean fuel comprises $H_2$.

3. A process for enhancing the destruction of toxic organic materials by incineration as defined in claim wherein the clean fuel comprises CO.

4. A process for enhancing the destruction of toxic organic materials by incineration as defined in claim 1, wherein the clean fuel comprises $CH_4$.

5. A process for enhancing the destruction of toxic organic materials by incineration as defined in claim wherein the clean fuel comprises a paraffinic hydrocarbon.

6. A process for enhancing the destruction of toxic organic materials by incineration as defined in claim 1, wherein the quantity of clean fuel is contacted with the combustion effluents by injecting the clean fuel into the combustion effluents with a carrier gas.

7. A process for enhancing the destruction of toxic organic materials by incineration as defined in claim 6, wherein the carrier gas comprises air.

8. A process for enhancing the destruction of toxic organic materials by incineration as defined in claim 6, wherein the carrier gas comprises steam.

9. A process for enhancing the destruction of toxic organic materials by incineration as defined in claim 6, wherein the carrier gas comprises recycled combustion effluents.

10. A process for enhancing the destruction of toxic organic materials by incineration as defined in claim 1, wherein the clean fuel is substantially oxidized.

11. A process for enhancing the destruction of toxic organic materials by incineration as defined in claim 1, wherein the quantity of clean fuel contacted with the combustion effluents is less than about 0.2 wt % based on the combustion effluents.

12. A process for enhancing the destruction of toxic organic materials by incineration comprising the steps of:

(a) burning the toxic organic materials in a combustion zone which results in the formation of combustion effluents containing a quantity of unoxidized toxic organic materials, said combustion effluents passing into a combustion chamber downstream of the combustion zone;

(b) contacting a quantity of clean fuel with the combustion effluents at a point downstream of the combustion zone, wherein the quantity clean fuel contacted with the combustion effluents is in the range from about 0.01 wt % to about 0.5 wt % based upon the combustion effluents, and wherein the temperature of the combustion effluents at the point the clean fuel is contacted with the combustion effluents is in the range from about 700° C. to about 1200° C., said contacting occurring in the presence of $O_2$, the concentration of $O_2$ being sufficiently high so that some $O_2$ remains in the combustion effluents after oxidation of the clean fuel; and (c) allowing the clean fuel and the combustion effluents sufficient residence time in the combustion chamber to partially oxidize the clean fuel so as to increase the oxidation of the toxic organic materials.

13. A process for enhancing the destruction of toxic organic materials by incineration as defined in claim 12, wherein the clean fuel comprises $H_2$.

14. A process for enhancing the destruction of toxic organic materials by incineration as defined in claim 12, wherein the clean fuel comprises CO.

15. A process for enhancing the destruction of toxic organic materials by incineration as defined in claim 12, wherein the clean fuel comprises $CH_4$.

16. A process for enhancing the destruction of toxic organic materials by incineration as defined in claim 12, wherein the clean fuel comprises a paraffinic hydrocarbon.

17. A process for enhancing the destruction of toxic organic materials by incineration as defined in claim 12, wherein the quantity of clean fuel is contacted with the combustion effluents by injecting the clean fuel into the combustion effluents with a carrier gas.

18. A process for enhancing the destruction of toxic organic materials by incineration as defined in claim 17, wherein the carrier gas comprises air.

19. A process for enhancing the destruction of toxic organic materials by incineration as defined in claim 17, wherein the carrier gas comprises steam.

20. A process for enhancing the destruction of toxic organic materials by incineration as defined in claim 17, wherein the carrier gas comprises recycled combustion effluents.

21. A process for enhancing the destruction of toxic organic materials by incineration as defined in claim 12, wherein the clean fuel is substantially oxidized.

22. A process for enhancing the destruction of toxic organic materials by incineration as defined in claim 12, wherein the quantity of clean fuel contacted with the combustion effluents is less than about 0.2 wt % based upon the combustion effluents.

23. An incinerator for enhancing the destruction of toxic organic materials by incineration comprising:

means for burning a quantity of waste in a combustion zone which results in the formation of combustion effluents, said combustion effluents containing a quantity of unoxidized toxic organic materials;

a combustion chamber located downstream of the combustion zone such that the combustion effluents pass from the combustion zone into the combustion chamber;

means for injecting a quantity of clean fuel into the combustion chamber such that the combustion effluents and the clean fuel are mixed, said quantity of clean fuel being injected with a carrier gas, and said quantity of clean fuel having a concentration in the range from about 0.01 wt % to about 0.5 wt % based upon the combustion effluents, said injecting means being located at a point in the combustion chamber where the temperature of the combustion effluents is in the range from about 700° C. to about 1200° C.; and means for controlling the residence time of the clean fuel and the combustion effluents within the combustion chamber so as to partially oxidize the clean fuel thereby increasing the oxidation of the toxic organic materials.

24. An incinerator as defined in claim 23, wherein the quantity of clean fuel comprises $H_2$.

25. An incinerator as defined in claim 23, wherein the quantity of clean fuel comprises CO.

26. An incinerator as defined in claim 23, wherein the quantity of clean fuel comprises $CH_4$.

27. An incinerator as defined in claim 24, wherein the quantity of clean fuel comprises a paraffinic hydrocarbon.

28. An incinerator as defined in claim 24, wherein the quantity of clean fuel injected into the combustion chamber is less than about 0.2 wt % based upon the combustion effluents.

29. An incinerator as defined in claim 24, wherein the carrier gas comprises air.

30. An incinerator as defined in claim 24, wherein the carrier gas comprises steam.

31. An incinerator as defined in claim 24, wherein the carrier gas comprises recycled combustion effluents.

* * * * *

UNITED STATES PATENT AND TRADEMARK OFFICE

CERTIFICATE OF CORRECTION

PATENT NO. : 4,974,530

DATED : December 4, 1990

INVENTOR(S) : RICHARD K. LYON

It is certified that error appears in the above-identified patent and that said Letters Patent is hereby corrected as shown below:

Column 1, lines 27-28, after "laboratory" insert --simulations, there may also be problems in the government--
Column 1, line 29, delete "a"
Column 2, line 16, after "that" insert --,--
Column 2, line 17, after "burn" insert --,--
Column 2, line 32, "Meetino" should be --Meeting--
Column 5, line 68, after "upon" insert --their measured oxidation rates at higher concentrations. It--
Column 6, line 51, "stem" should be --steam--
Column 9, line 24, after "oxidized" insert --.--
Column 9, line 27, "Modelino" should be --Modeling--
Column 9, line 54, "1.8 x 10°" should be --$1.8 \times 10^{-2}$--
Column 9, line 64, "ppm" should be --ppm.--
Column 9, line 65, "7.4 x 10" should be --$7.4 \times 10^{-7}$--
Column 11, line 41, "$C_2H_6$" should be --$C_6H_6$--
Column 12, line 54, "having an varying" should be --having a varying--
Column 15, line 16, delete "or"
Column 15, line 20, "claim" should be --claim 1,--
Column 15, line 26, "claim" should be --claim 1,--

Signed and Sealed this

Eighth Day of September, 1992

*Attest:*

DOUGLAS B. COMER

*Attesting Officer*

*Acting Commissioner of Patents and Trademarks*